US006286186B1

(12) United States Patent
Lautenschläger et al.

(10) Patent No.: US 6,286,186 B1
(45) Date of Patent: Sep. 11, 2001

(54) FURNITURE HARDWARE DEVICE

(75) Inventors: Horst Lautenschläger, Reinheim; Gerhard Wilhelm Lautenschläger, Brensbach-Wersau, both of (DE)

(73) Assignee: MEPLA-Werke Lautenschläger GmbH & Co. KG (DE)

( * ) Notice: Subject to any disclaimer, the term of this patent is extended or adjusted under 35 U.S.C. 154(b) by 0 days.

(21) Appl. No.: 08/633,647

(22) Filed: Apr. 12, 1996

(30) Foreign Application Priority Data

May 16, 1995 (DE) ..... 195 17 924

(51) Int. Cl.[7] ..... E05D 7/12; E05D 5/00

(52) U.S. Cl. ..... 16/272; 16/383; 16/384; 16/258

(58) Field of Search ..... 16/272, 383, 384, 16/258, 261, 264, 388, 387, DIG. 40, DIG. 43

(56) References Cited

U.S. PATENT DOCUMENTS 4,021,881 * 5/1977 Lautenschlager ..... 16/383
4,622,716 * 11/1986 Lautenschlager ..... 16/384
5,463,796 * 11/1995 Brustle et al. ..... 16/383

FOREIGN PATENT DOCUMENTS 1559940 3/1972 (DE) .
2524503 * 12/1976 (DE) ..... 16/383
2727962 1/1979 (DE) .
3516911 11/1986 (DE) .
4336326 4/1995 (DE) .

* cited by examiner

*Primary Examiner*—Chuck Y. Mah
(74) *Attorney, Agent, or Firm*—Dvorak and Traub

(57) ABSTRACT

Furniture hardware device (20) which can be fastened to the wall of a piece of furniture because it has fastening means projecting from its surface facing the furniture wall, which can be introduced into bores in the wall of the furniture and can be secured against withdrawal from the bores. At least one of the fastening means is configured as a fastening stud which has at least one knife-edged projection (60) running substantially circumferentially. The fastening stud or studs can be shifted between a mounting position in which the at least one knife-edged projection is withdrawn into the interior of the associated bore, and a fastening position in which they cut into the wall of the fastening bore.

22 Claims, 7 Drawing Sheets

FURNITURE HARDWARE DEVICE

BACKGROUND OF THE INVENTION

The invention relates to a furniture hardware device having a mounting piece to be applied to a furniture wall, which has a bearing surface from which fasteners for insertion into bores in the furniture wall project substantially at right angles at a distance apart. At least one of the fasteners is a separately made stud which has at its free end at least one circumferential sharp-edged projection and is mounted for displacement between two end positions such that in the one end position the sharpened projection or projections cut into the wall of the bore in the furniture wall, and in the other end position they are withdrawn within the interior of the bore.

A great number of different systems have been developed for installing furniture hardware and parts on doors made of wood material. In addition to those in which a hardware piece once installed can hardly be removed without damage to the wood material, systems have also been developed which allow easy and repeated installation and removal of the hardware. In addition to studs which can be expanded like expansion bolts and be positively locked in a bore in the furniture wall, systems have also been developed which permit a positive locking of pin-like or cup-shaped pieces in bores or mortises in the wall because in the actual installation procedure sharpened or pointed locking projections initially retracted within the wall of the pin-like or cup-shaped mounting means, are forced by external manipulation into the wall of the bore or milled recess in the furniture wall and thus produce a positive lock. By another manipulation in the reverse sense, however, the locking means can be withdrawn again from the wall of the bore, thus permitting easy removal of the hardware piece fastened in this manner. By the above-described manipulations an excentric component rotatably held in the mounting means can be turned by a given angular amount and shifted either indirectly through intermediate members or through locking means provided directly thereon into the positive locking position or out of the locking position. For such manipulation, suitable tools, such as screwdrivers or the like, are then usually necessary in order to apply a sufficient force to cause the locking means to penetrate into the wall of the associated bore or mortise.

In many cases, however, especially in the case of hardware for "do-it-yourself" installation, or knock-down furniture that is assembled by lay people, suitable tools are not available in every case. But proper assembly with inappropriate tools, i.e., tools that do not fit, is not assured.

SUMMARY OF THE INVENTION

The invention, however, is addressed to the problem of constructing furniture hardware of many different kinds such that they can be installed easily and quickly even by inexperienced persons without the use of special tools and without substantial application of force.

Setting out from a piece of furniture hardware of the kind mentioned above, this problem is solved according to the invention in that studs, each provided with at least one knife-edged projection, are slightly tapered towards their free end on about half of their periphery, while the other half of the periphery is somewhat semi-cylindrical, and the sharpened projection or projections protrude from the semi-cylindrical half of the stud; in that the stud or studs provided with the sharpened projections are disposed on a separate flat stud plate; in that the flat stud plate is mounted for pivoting at a given angle on its mounting; in that the semi-cylindrical half of the stud is inclined when in the first end position in the bore in the furniture wall such that the sharpened projection or projections are withdrawn within the bore in the furniture wall receiving the stud, but in the second end position they pierce the wall of the bore, and that a means engaging the stud plate on the one hand and the mounting plate on the other is provided for turning the stud plate from the one to the other position. The locking means formed by the sharpened projections are thus engaged in the surrounding wall of the bore or disengaged from it by pivoting the stud, while a lever is provided on the hardware it self for this pivoting movement.

The configuration is desirably made such that the mounting piece is in the form of an elongated mounting plate from whose bottom surface two studs project at a distance apart, each having a radially extending knife-edged projection.

The studs can then be held on the mounting plate such that their free ends are drawn toward one another in their first end position, while in the second end position they will be further apart; their knife-edged projections are provided on the half of the stud facing away from the other stud.

Alternatively, the studs can be held on the mounting plate such that their free ends have in the first end position a greater distance apart than in the second end position, in which case the knife-edged projections provided on each stud will be on the stud half facing the other stud.

It may be expedient also to provide on the mounting plate a stud-like or cup-like centering means projecting from the bearing surface into a bore in the furniture wall.

Alternatively, the configuration may also be made such that the mounting piece is in the form of an elongated plate on the bottom of which there are fastening studs spaced apart from one another and provided each with at least one knife-edged, radial projection, plus a holding stud rigidly disposed on the plate, the holding stud being likewise made to taper slightly toward its free end on half of its periphery, while the other half of its periphery is somewhat semi-cylindrical in section, and at least one radially extending projection running substantially in the circumferential direction reaches out from the semi-cylindrical half of the stud. When the device thus configured is installed, first the holding stud is introduced into the corresponding bore with the mounting piece held at an angle such that the wall of the bore will not be damaged by the projection. When the holding stud is then fully inserted into the bore and the mounting piece is lowered from its slanting position until its bottom is in contact with the furniture wall, sharpened projections provided on the holding stud penetrate into the wall of the bore. During this lowering operation the fastening stud must be in the appropriate angular end position so that it can be introduced without forcing into the associated mounting bore. After the device reaches the desired position for setting the hardware on the furniture wall, the fastening stud is brought by manipulating the lever to the other angular position and thus fixes the hardware piece on the furniture wall.

Each fastening stud can be provided on a separate, flat plate, in which case a lever engaging this stud plate on the one hand and the mounting plate on the other is provided for the purpose of turning the stud plate from the one end position to the other.

Expediently, the stud plate is biased resiliently to the first end position.

In an advantageous embodiment of the invention, the stud plate is placed on a sloping section on the upper side of the mounting plate and the fastening stud is introduced through an opening in the mounting plate, the lever being held on a portion of the mounting plate at a distance from the stud, and the angle included between the sloping section of the mounting plate and the plane of the furniture wall being substantially equal to the angle between the first and second end positions of the stud. The lever then expediently engages the stud plate in an area thereof at a distance from the mounting area on the mounting plate.

The stud plate ought best to be a substantially flat plate with the studs projecting from its flat bottom.

The stud plate and the fastening stud can be made in one piece of metal. The substantially flat plate can be rectangular in shape and can be joined to the mounting plate near its margin facing the other stud or holding stud, while the lever then will engage the opposite marginal area of the flat plate facing away from the stud.

In that case an embodiment will be advantageous in which the lever will be linked to the marginal area of the flat plate remote from the other stud, for pivoting about an axis parallel to the pivot axis of the stud, and will have a lever-like handle for turning it from a position lowered onto the mounting plate to a raised position, and on the lever at least one cam, excentric or the like is provided which in the lowered position of the handle thrusts the flat plate, in an area facing away from the other stud, away from the mounting plate, and this cam or the like is turned to a position shifted away from contact with the mounting plate.

If the furniture hardware piece is designed as a door-related member of a hinge, it is expedient that the mounting plate be a flange integral with the upper rim of the cup of a cup-type hinge member.

The handle can then best have the shape, in plan, of a plate having at least in part an outline congruous with the mounting flange and placed over it. When in the proper fastening position, the handles will then be in line on the flange and will not appear to be separate components.

The bottom of the handle is then expediently provided with a recess accommodating the stud plate, this recess being created by means of a marginal strip projecting toward the mounting flange and running substantially around the edge of the handle.

The cam or cams or excentrics or the like are then expediently formed on a portion of the marginal strip of the handle facing away from the cup.

The handle can then be pivoted on the stud plate such that in the margin of the stud plate remote from the cup an indentation is provided which reaches slightly into the stud plate itself, and the edge of the stud plate is disposed in it; the stud plate has in its portion within the indentation a through-bore located above the flange and running parallel thereto, through which a pivot pin is passed, whose ends protruding from the plate are set in bores in the handle in its marginal lip.

In a door-hanging hardware device, the mounting flange is disposed substantially transversely to the longitudinal central plane of the cup device, so that it protrudes from both sides of the cup. It is then expedient to provide a stud in each of the two lateral wings of the mounting flange. The cup device, when set in its mortise, will then serve the function of the centering means referred to above.

The use of the principle of the invention is not limited to door-hanging hardware. Instead, the mounting plate can also be configured for the adjustable mounting of the door-related member of cabinet hinges.

Another possibility is to make it part of a joining device by providing on the upper side of the mounting plate means which can be brought into releasable engagement with an associated piece of hardware. It can be a so-called corner connector for furniture walls, or else a device by which drawer fronts can be joined to drawer sides.

BRIEF DESCRIPTION OF THE DRAWINGS

The invention is further explained in the following description of a number of embodiments, in conjunction with the drawing wherein.

DETAILED DESCRIPTION OF THE INVENTION

Figure 1:
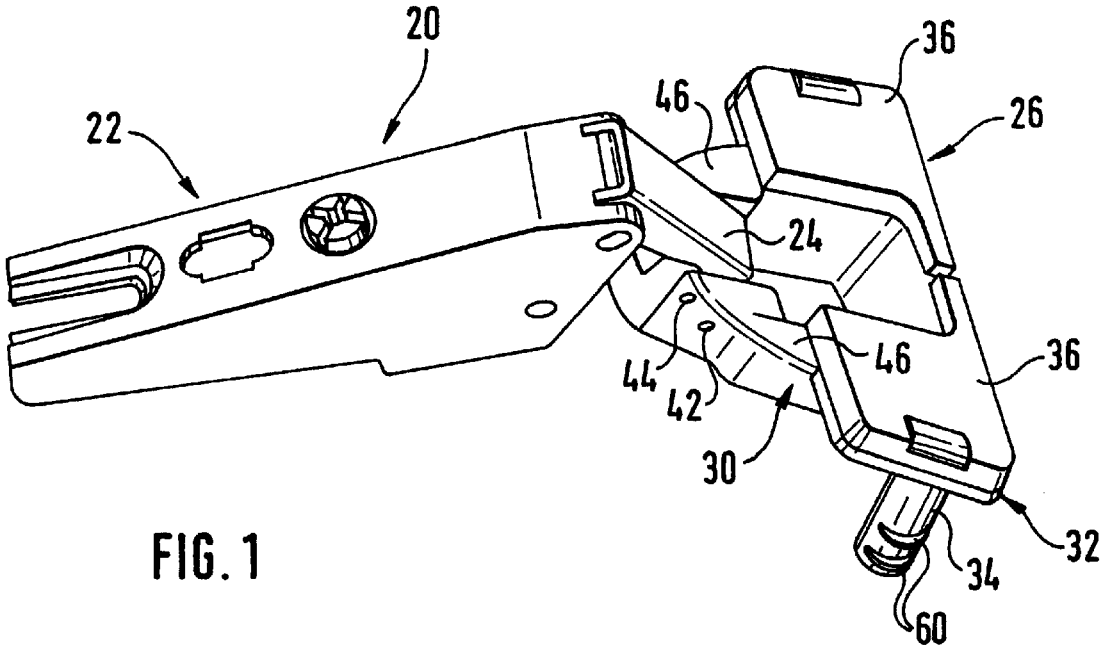
FIG. 1 is a perspective view of a furniture hinge with a door-related mounting piece according to a first embodiment of the invention.
Figure 2:
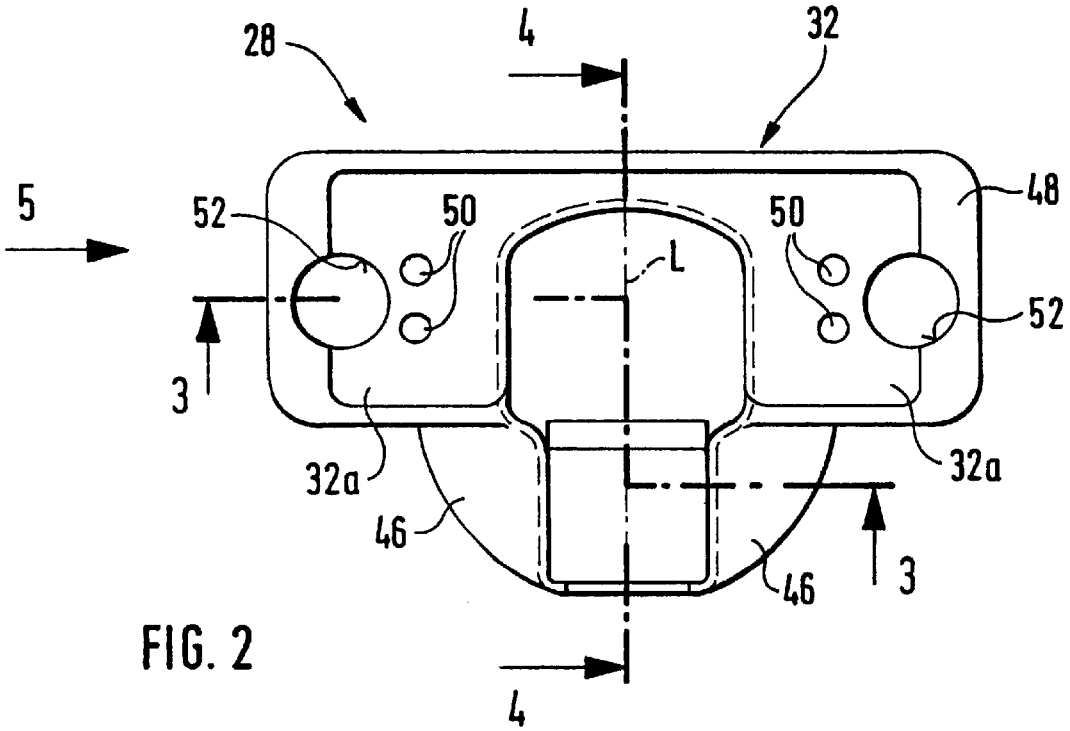
FIG. 2 a top plan view of the door-related cup-type hinge member stamped from sheet metal, without the mounting studs.
Figure 3:
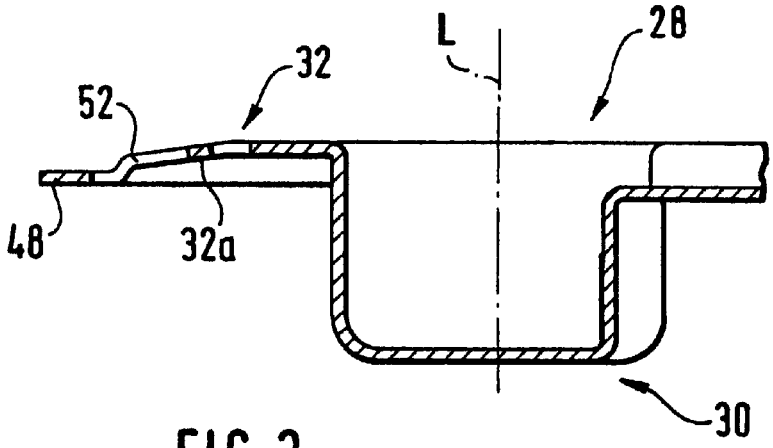
FIG. 3 is a cross section taken along the line indicated in FIG. 2 by the arrows 3—3.
Figure 4:
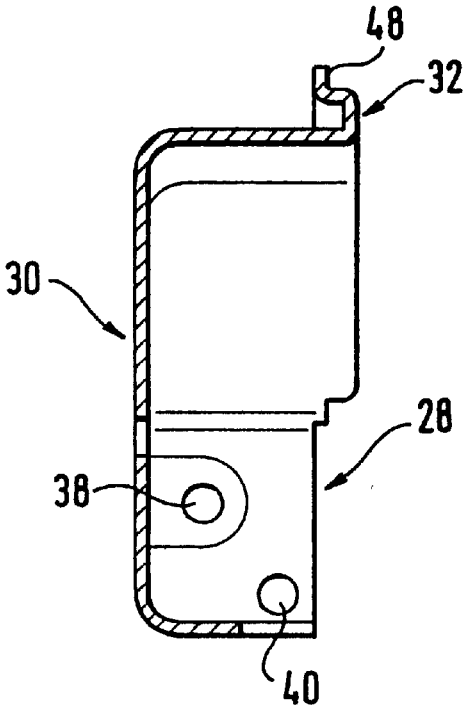
FIG. 4 is a cross section seen in the direction of the arrows 4— 4 in FIG. 2.
Figure 5:
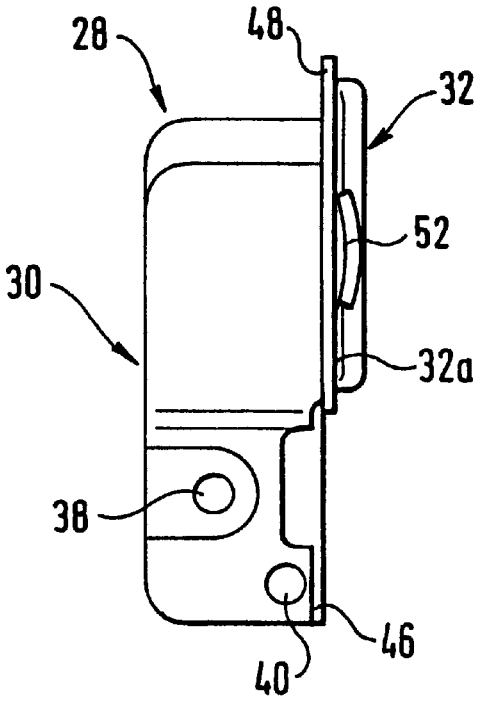
FIG. 5 is a side view seen in the direction of arrow 5 in FIG. 2.

In FIG. 1 a furniture hinge identified as a whole by 20 is represented schematically, in which a carcase-related member in the form of an elongated supporting arm 22 to be adjustably fastened to the side wall of a cabinet is coupled by an articulation formed by two links, of which only the one hinge link 24 is shown, to a door-related hinge member in the form of a cup-like device sunk into a mortise in the back of a door (not shown); this is the first embodiment of a furniture hardware device configured in the manner of the invention. The hinge member or cup 28 itself, made by stamping and drawing from sheet metal, can be configured in the manner described below in conjunction with FIGS. 2 to 5, and is then held releasably in and on the door by means of two mounting devices to be further described in conjunction with FIGS. 6 to 8 and 9 and 10.

The hinge cup 28 shown in FIGS. 2 to 5 without the said mounting devices is composed of the cup itself which can be sunk in the corresponding mortise in the door and a mounting flange 32 integral with its upper lip and projecting laterally on both sides; its bottom facing the door rests on the inside face of the door when the cup 26 is installed. Studs 34 spaced apart on the underside of the mounting flange 32 engage in associated bores in the door; they are separately made and will be described below in conjunction with FIGS. 9 and 10. The upper side of the mounting flange 32 is covered by two operating levers 36 each associated with one stud 34; these are of such shape that together they just cover the mounting flange 32. One of these operating levers 36 is shown separately in FIGS. 6 and 8 and their configuration will be described in detail in connection with these drawing figures.

The actual cup 30 of the cup-like device, which is to be sunk in a mortise on the back of a door, is of the shape of a tub with flattened sides in which holes 38 and 40 are punched, in which the ends of the pivot pins 42, 44 (FIG. 1), which hold the links of the linkage, are fastened by riveting. The mounting flange 32 reaches laterally over the mortise in the door, the mortise being circular in plan, and thus it covers the space between the cup 30 and the wall of the mortise. At the front portion adjacent the edge of the door (at the bottom in FIG. 2), however, this space is covered by sections 46 depressed below the upper margin of the cup 30 from the sheet metal of the hinge cup 28 of circular outline corresponding to the diameter of the mortise, so that the mortise in the door is completely covered when the door-related hinge member 26 is installed.

The mounting flange 32 is embossed within an outer rim 48 which has outwardly sloping portions 32*a* provided symmetrically on opposite sides of the longitudinal central plane L of the cup 38, in each of which two holes 50 of small diameter longitudinally spaced apart, and further out from them one larger opening 52, are provided.

On each of the sloping portions 32*a* a stud holding means 54 is provided, in the form of a flat plate from the bottom of which, facing the sloping portion 32*a*, the integrally joined stud 34 projects, and also two short studs 56 which can be fitted through the holes 50 in the mounting flange and then can be riveted from the bottom of the flange facing the door. The stud holding means is thus held against the sloping sections 32*a* on the mounting flange. In the outer marginal area opposite the stud 56, the stud mounting means 54 configured as a flat plate is of thicker material and provided with a through-bore 58 running at a parallel distance above the mounting flange and parallel to the longitudinal central plane L of the cup.

Figure 9:
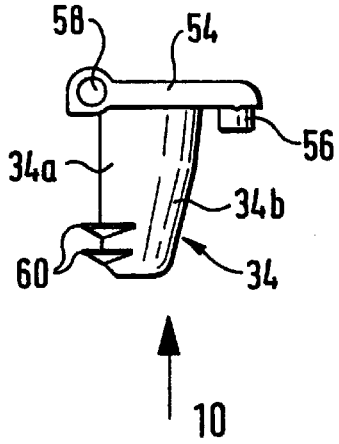
FIG. 9 is a side view of one of the two studs provided in the embodiment of FIG. 1.
Figure 10:
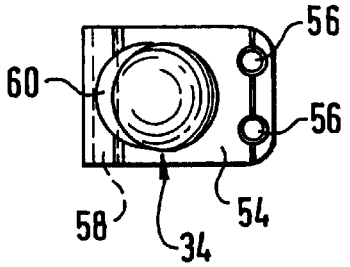
FIG. 10 is a view of the stud seen in the direction of arrow 10 in FIG. 9.

The stud has the shape represented in FIGS. 9 and 10, i.e., on its side 34*a* it is semicylindrical, the central axis of the cylinder being at right angles to the bottom of the stud holding plate. At its bottom part two knife-edged projections 60 protrude from the semicylindrical side.

On the opposite side 34*b*, i.e., the side facing the cup, the stud 34 is slightly tapered, to such a degree that, since the stud mounting means 54 is on the sloping section 32*a* of the mounting flange 32, the stud as a whole will be within the walls of the corresponding mortise in the door. Not until the margin containing the bore 58 is lifted up by the sloping section 32*a* of the mounting flange does the stud 34 simultaneously perform a clockwise pivoting movement, so that the semicylindrical side 34*a* is placed against the wall of the mortise. Simultaneously, the sharpened projections 60 penetrate the wall of the mortise and thus lock the stud positively in the bore.

Figure 6:
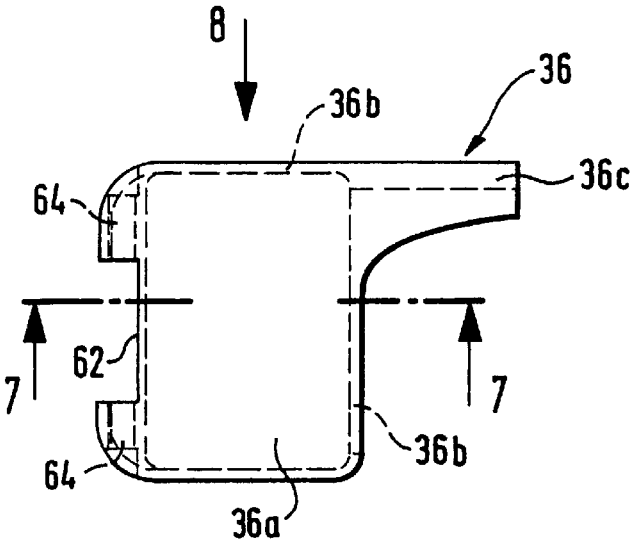
FIG. 6 is a plan view of one of the two levers provided in the embodiment according to FIG. 1, for operating the studs.
Figure 7:
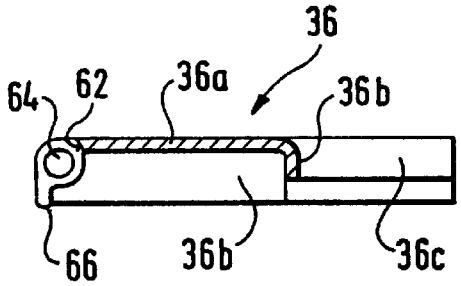
FIG. 7 is a cross section along line 7—7 in FIG. 6.
Figure 8:
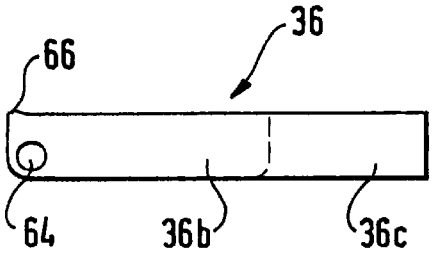
FIG. 8 is a view seen in the direction of arrow 8 in FIG. 6.

In order to force the stud mounting means 54 away from the sloping section 32*a* in the manner described above, the lever 36, separately represented in FIGS. 6 to 8, is provided, which is configured to the one half of the mounting flange in the manner shown in plan in FIG. 6. In the area 36*a* lying above the stud holding means 54 the lever 36 is in the form of a flat body in whose bottom a recess is formed by a marginal strip 36*b* projecting toward the mounting flange 32, in which the stud holding means 54 is accommodated. The circumferential marginal strip 36*b* is interrupted in the marginal part of the lever facing away from the cup part by an indentation 62 reaching in part into the area 36*a*, in which lies the margin, provided with the through-bore 58, of the stud holder 54 configured as a flat plate. The ends of a fulcrum pin, not shown, which protrude from the through-bore 58 are then journaled in bores 64 in the stud holder. The arms 36*c* of the lever 36, adapted to the shape of the mounting flange 32, simultaneously serve as handles by means of which the lever can be brought into the desired end positions.

Figure 11:
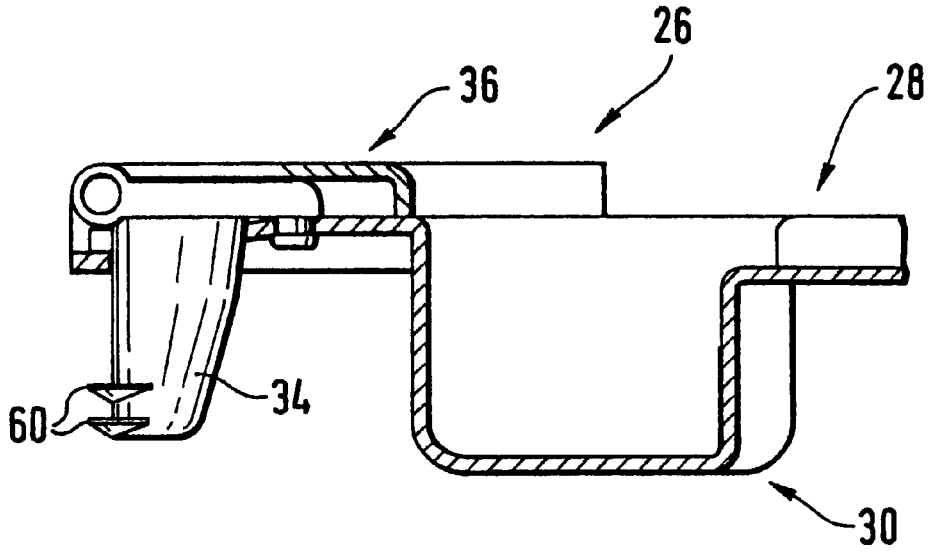
FIG. 11 is a view corresponding to the section shown in FIG. 3 through the cup-type hinge member with the studs installed and the lever with the hinge member in the mounted position.

Low, projecting cams 66 are formed at the free margins of the sections of the marginal strip 36*b* remaining laterally alongside the indentation 62, and in the lowered state of the lever represented in FIG. 11 they are thrust against the planar outer circumferential margin 48 of the mounting flange 32. Thus, the marginal portion of the stud holding means 54 provided with the through bore 58 and facing away from the cup is forced to the position, seen also in FIG. 11, in which it is lifted away from the sloping section 32*a*, in which the stud 34 is in its intended locking position wherein the knife-edged projections 60 cut into the wall of the mortise in the door.

Figure 12:
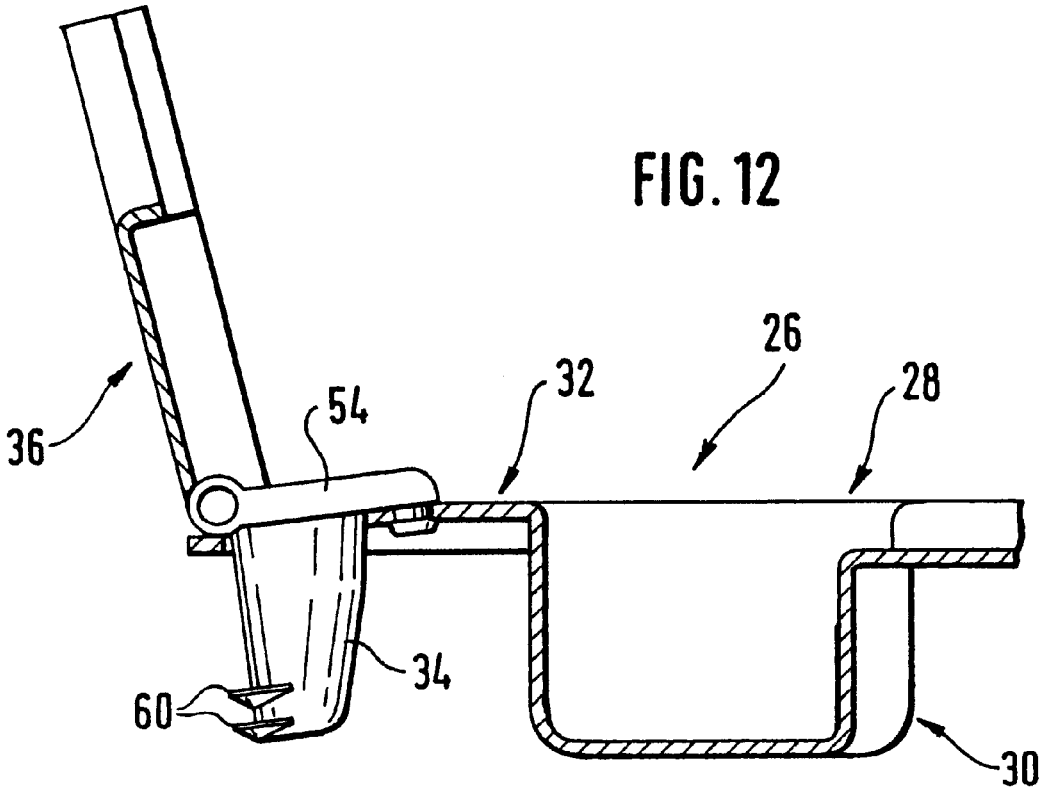
FIG. 12 is a sectional view corresponding to FIG. 11, in which the stud is turned to the position for installation or removal.

In FIG. 12, however, the lever 36 is raised up, so that the cams 66 are turned away from their position thrusting against flange 32 and the stud holding means 54 is lowered onto the associated sloping section 32*a* of the flange. Thus the stud 34 is swung back to the releasing position wherein the sharpened projections 60 come free of their engagement in the wall of the mortise. In this position, represented in FIG. 12, the cup member 28 can thus be removed from the door without the application of force.

Figure 13:
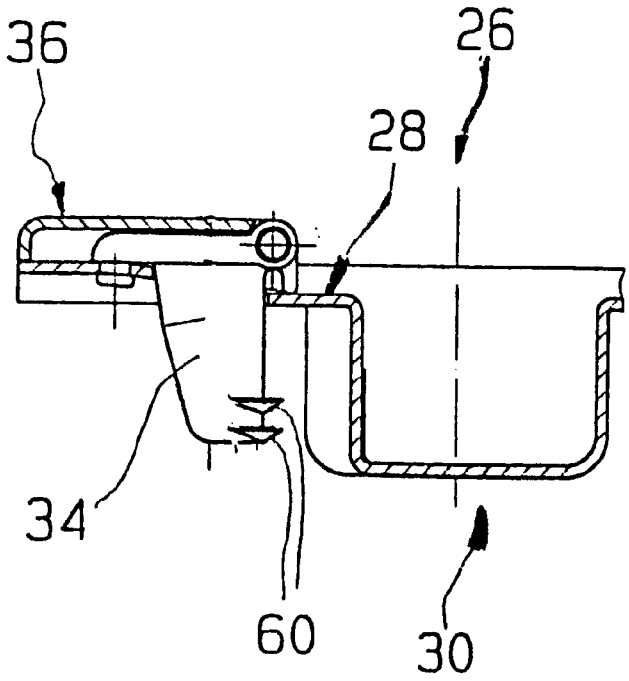
FIG. 13 is a view corresponding to FIG. 11 but showing an alternative embodiment of a cup-shaped hinge member with the studs installed and the lever with the hinge member in the mounted position.
Figure 14:
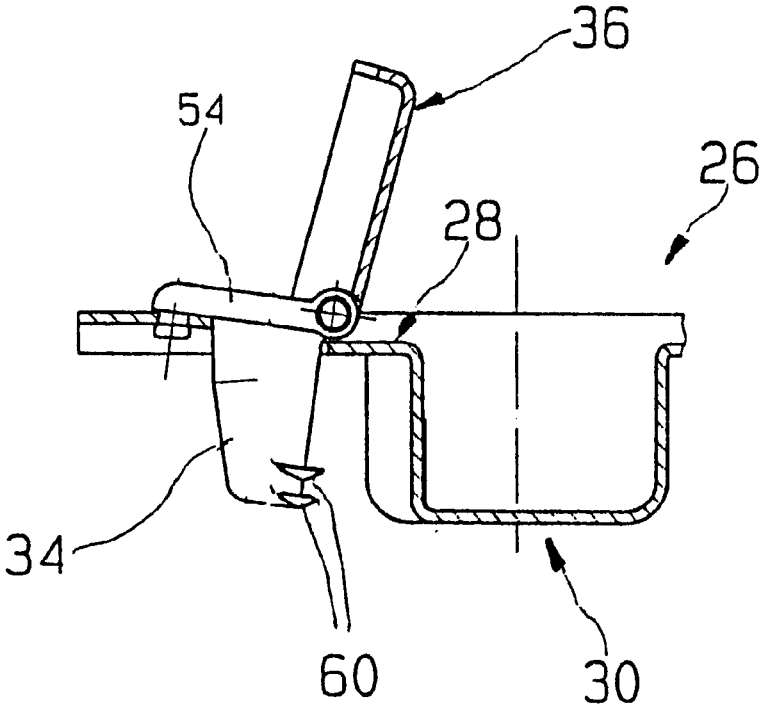
FIG. 14 is a sectional view corresponding to FIG. 13 in which the stud is turned to the position for installation or removal.

In FIGS. 13 and 14, a modification of the arrangement shown in FIGS. 11 and 12 is depicted. The modification lies in the arrangement of the fastening studs 34 on the fastening plate 32 such that their free ends are a greater distance apart in the first end position and closer together in the second end position. The knife-edged projections 60 provided on each of the fastening studs 34 are provided then on a half of each of the fastening studs facing toward the other fastening stud 34.

Figure 15:
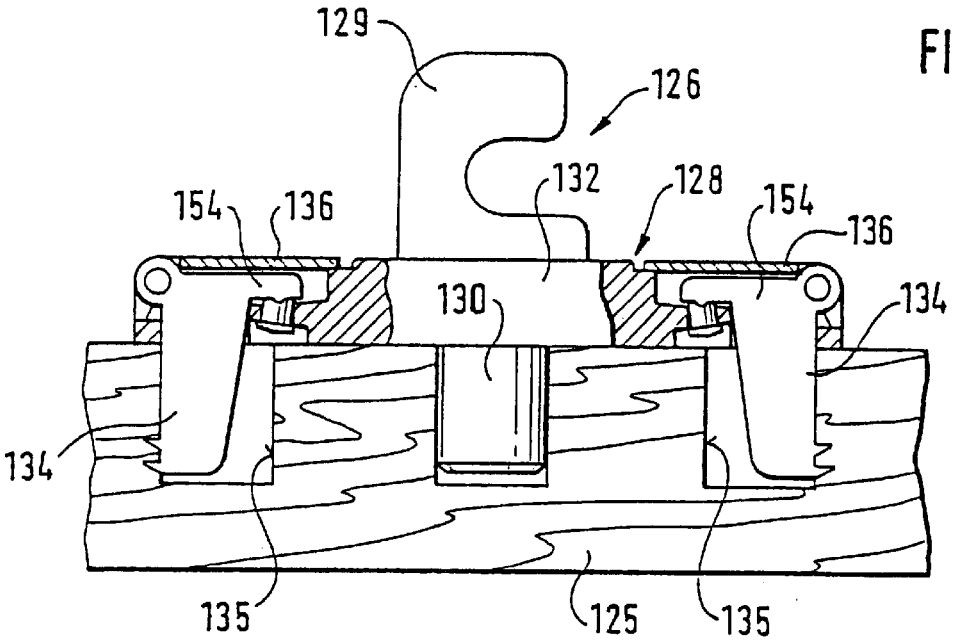
FIG. 15 is a partially cut-away side view of a second embodiment designed as part of a device for the removable attachment of a drawer front to a drawer, in the state in which it is mounted on the inner side of the drawer front.
Figure 16:
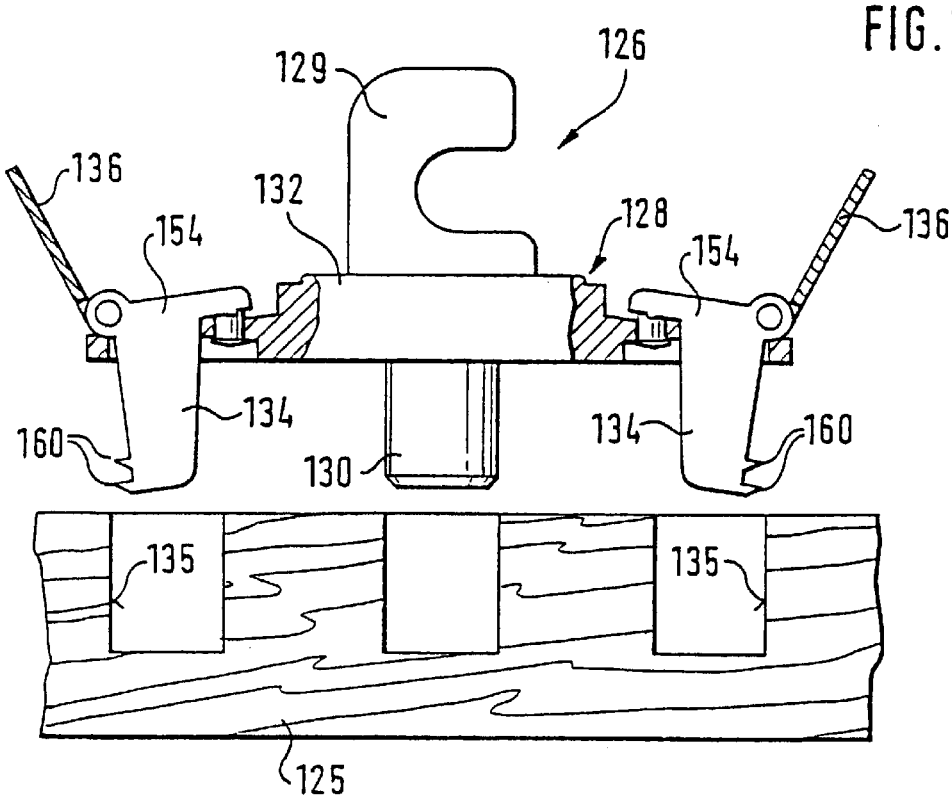
FIG. 16 is a view corresponding to FIG. 15, in which the piece for fastening the drawer front is represented still lifted away from the drawer front prior to installation.

A second embodiment of a hardware piece according to the invention is shown in FIGS. 15 and 16 in a manner comparable to FIGS. 11 and 12. The piece indicated in its entirety at 126 is in this case part of a drawer front mounting device, which is a hook member to be fastened to the inside of a drawer front 125, and cooperating with a mounting piece installed on or in a side of the drawer, and it is not described further since it is known in itself. As it appears from a comparison of FIGS. 15 and 16 with FIGS. 11 and 12, the hardware pieces 26 and 126 are mounted in a comparable manner by studs 134 provided at opposite ends of an elongated mounting plate 132 corresponding to mounting plate 32, which are made in basically the same manner as studs 34, the pivoting of the studs 134 being performed by lever 136. The way in which these levers 136 are pivoted on the stud holder 154 is likewise the same as in the previous embodiment, so that, to avoid repetition, it will suffice to refer to the previous description, inasmuch as functionally equal components of the two embodiments are given the same reference numbers in the drawings, preceded in the case of component 126 by a numeral 1.

It can be seen that the cylindrical stud 130 projecting centrally from the bottom facing the drawer-front serves here as a centering means, which sets or centers the member 126 lengthwise of the mounting plate 132, even when the studs 134 are not both turned to the fastening position, i.e., the forces developing between the studs 134 and the wall of the mortise 135 in the drawer front 125 are applied not simultaneously but successively to the mounting plate 132.

Figure 17:
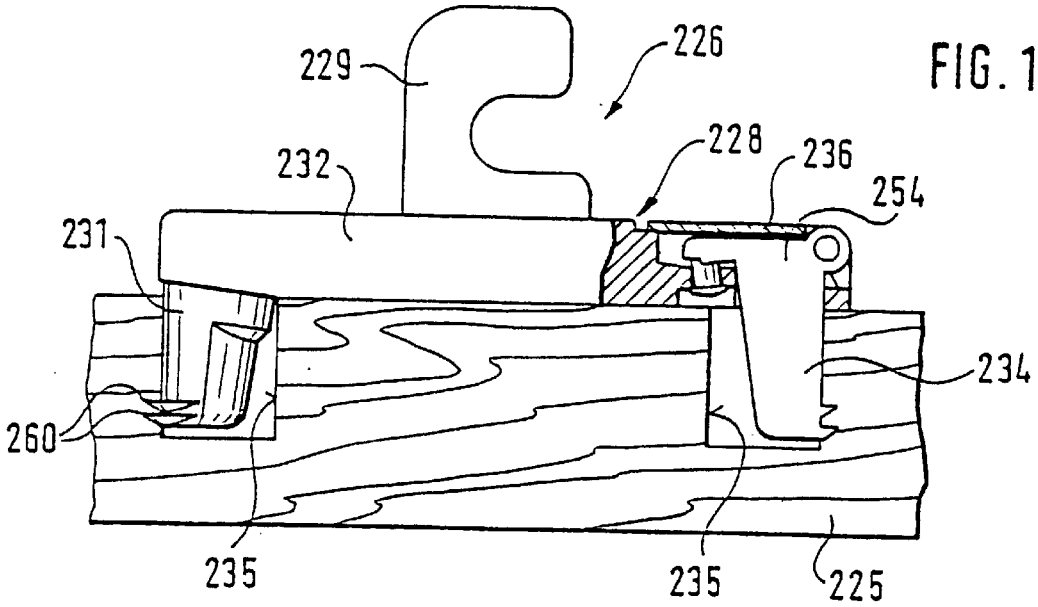
FIG. 17 is a partially cut-away side view of a third embodiment of drawer front mounting hardware as installed on the back of the drawer front.
Figure 18:
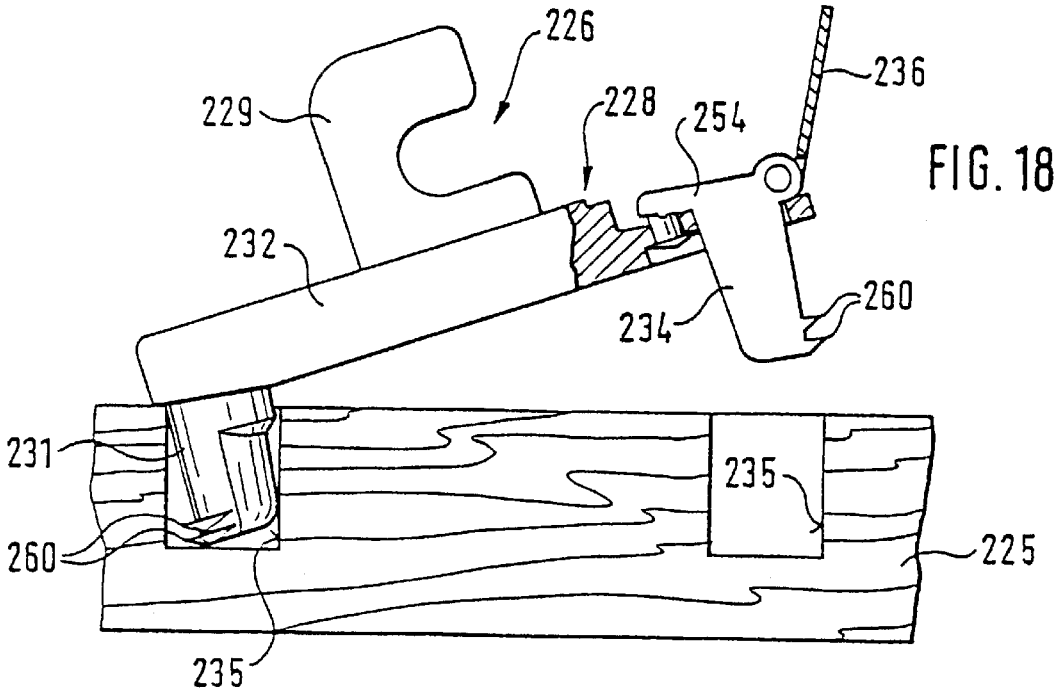
FIG. 18 is a view corresponding to FIG. 17 wherein the mounting hardware is shown in the partially installed state during the installation procedure.

In FIGS. 17 and 18 there is shown a third example of a furniture hardware piece 226 which is a simplified embodiment of the hardware piece 126. Since in FIGS. 15 and 16, functionally comparable components of the piece 226 are associated with the same references as in the hardware piece 126, and a number 2 instead of the 1 is prefixed to the reference number, it will suffice hereinafter to explain only the relevant modifications and simplifications.

It can be seen that the plug forming the centering means protruding from the bottom of the mounting plate 232 is eliminated. Its function is combined with the second stud 231 shown in the drawing on the left side which protrudes fixedly from the bottom of the mounting plate 232. The stud 231 has the same basic configuration as the stud 234 but, as stated, it is fixedly attached to the mounting plate 232. The pivoting of the stud from the one to the other end position during the installation of device 226 is accordingly replaced by rocking the device 231 inserted into the bore 235 at an angle as shown in FIG. 18. As soon as the stud 231 has been fully inserted into the bore 235 the device 226 is turned to bring the bottom of mounting plate 232 against the inside of the drawer front 225. The stud 234 shown in the end position represented in FIG. 18 can thus enter into the bore without damaging the wall of the bore 235. By turning the lever 236 down, the stud 234 is then shifted to the fastening position in which the sharp-edged projections 260 penetrate into the wall of the bore 235. The result of the reaction force transmitted through the mounting plate 232 to the stud 231 is that the knife-edged projections 260 additionally penetrate into the wall of the bore 235 and fasten the hardware piece 226 to the drawer front 225 on the manner shown in FIG. 17.

It can be seen that modifications and improvements of the embodiments described are practical within the scope of the idea of the invention and they also relate to the fact that furniture hardware designed for a different task, for example corner connection or other connecting devices, can be installed and removed quickly and simply without tools.

What is claimed is:

1. A mounting device for securing hardware to a furniture wall, comprising a fastening plate comprising on an underside thereof a bearing surface for bearing against a furniture wall, at least two spaced apart fasteners projecting from the bearing surface at substantially right angles thereto for insertion into associated bores in the furniture wall, at least one of the fasteners being a fastening stud having at its free end remote from the bearing surface at least one circumferential knife-edged projection, the fastening stud tapering conically at an angle towards its free end over approximately half the circumference of the fastening stud, while a remaining approximate half of the circumference is substantially semicylindrical, the knife-edged projection projecting from said semicylindrical half of the fastening stud, said fastening stud being mounted for displacement between two end positions such that in a first end position the at least one knife-edged projection cuts into a lateral wall of one of the associated bores in the furniture wall, and such that in a second end position the at least one knife-edged projection resides within the bore but does not cut into the lateral wall thereof, said fastening stud being disposed on a stud-holding element mounted pivotingly at a given angle on the bearing surface, which stud-holding element pivots along with the fastening stud between the first and second end positions thereof, and an operating means engaging the stud-holding element and the fastening plate for switching the stud-holding element between the first and second end positions.

2. The mounting device according to claim 1, wherein the fastening plate has the form of an elongated mounting plate.

3. The mounting device according to claim 2, wherein at least two of the fasteners are fastening studs held on the fastening plate such that their free ends are closer together in the first end position, while in their second end position they are a greater distance apart, and that the knife-edged projections provided on each of the fastening studs are provided on a half of each of the fastening studs facing away from the other fastening stud.

4. The mounting device according to claim 2, wherein at least two of the fasteners are fastening studs held on the fastening plate such that their free ends are closer together in the second end position, while in their first end position they are a greater distance apart, and that the knife-edged projections provided on each of the fastening studs are provided on a half of each of the fastening studs facing toward the other fastening stud.

5. The mounting device according to claim 2, wherein on the fastening plate there is additionally provided a centering means projecting from the bearing surface for entry into a mating bore in the furniture wall.

6. The mounting device according to claim 5, further comprising a door-related hinge member having a cup portion, wherein the fastening plate configured as a mounting flange integrally extends outwardly from an upper free margin of the cup portion.

7. The mounting device according to claim 6, wherein the operating means has in plan view the shape of a flat body having an outline congruous with at least a portion of an outline of the mounting flange and being disposed on the mounting flange in alignment with said portion thereof.

8. The mounting device according to claim 7, wherein the bottom of the flat body facing the mounting flange has a recess for accommodating the stud-holding element configured as a flat plate.

9. The mounting device according to claim 8, wherein the recess is formed by a marginal strip running substantially along the border of the flat body and projecting toward the mounting flange.

10. The mounting device according to claim 9, wherein the at least one cam is formed on the portion of the marginal strip facing away from the cup portion.

11. The mounting device according to claim 8, wherein, in the marginal area of the flat body facing away from the cup portion, a recess reaching through the marginal strip is provided, in which a region of the margin of the flat plate serving to retain the stud-holding element and facing away from the cup portion is disposed, the flat plate having in the area lying within the recess a through-bore running at a parallel distance above the mounting flange, and through said through-bore a pin passes, the ends of said pin projecting from the flat plate and each of said ends being lodged in a bore in the flat body in the marginal strip.

12. The mounting device according to claim 2, further comprising a door-related hinge member having a cup portion, wherein the fastening plate configured as a mounting flange integrally extends laterally from opposing ends of an upper free margin of the cup portion, wherein in each of the two laterally extending areas of the mounting flange a fastening stud is provided.

13. The mounting device according to claim 2, wherein the mounting plate is configured for the adjustable mounting of a supporting wall-related member of an associated furniture hinge.

14. The mounting device according to claim 2, further comprising a furniture hardware piece releasably joined to a face of the mounting plate facing the bearing surface by way of a joining means.

15. The mounting device of claim 2, wherein each fastening stud is provided on a separate flat stud holding element, and an operating means engaging the stud holding means and the fastening plate is provided for turning the stud holding element from a first end position to a second end position.

16. The mounting device according to claim 2, wherein the stud holding means is disposed lying on a sloping section on an upper face of the fastening plate and the fastening stud is passed through an opening in the fastening plate; the operating means being held on the fastening plate in an area at a distance from the fastening stud, the angle of the sloping section with respect to a remaining non-sloping section of the fastening plate with its plane being substantially parallel to the furniture wall in an installed position being substantially equal to an angle between the first and second end position of the fastening stud, and the operating means engaging the stud holding element at an area thereof at a distance from where the operating means is held on the fastening plate.

17. The mounting device according to claim 16, wherein the stud holding means has the form of a substantially flat plate from whose flat bottom the fastening stud projects.

18. The mounting device according to claim 16, wherein the stud holding means and the fastening stud are together an integral metal component.

19. The mounting device according to claim 17, wherein the substantially flat plate of the stud holding means is of approximately rectangular shape and is joined to the fastening plate in a first area of a margin of the flat plate nearest a line of planar symmetry running through the fastening plate, the operating means engaging an opposite second marginal area of the flat plate facing away from the line of symmetry.

20. The mounting device according to claim 19, wherein the operating means is linked to the second marginal area of the flat plate about an axis running parallel to the pivoting axis of the fastening stud, the operating means having a lever-like handle for turning from a first position lowered onto the fastening plate to a second raised position away from the surface of the fastening plate, and on the operating means resides at least one eccentric cam which, when the handle is in the first lowered position, is thrust into contact with the fastening plate thereby forcing the flat plate in the second marginal area thereof away from the surface of the fastening plate, and which, when the handle is in the second raised position, is turned from the position in contact with the fastening plate.

21. The mounting device according to claim 1, wherein one of the fasteners is a holding stud fixedly disposed on the fastening plate, the holding stud having at its free end remote from the bearing surface at least one circumferential knife-edged projection, the holding stud tapering conically at an angle towards its free end over approximately half the circumference of the holding stud, while a remaining approximate half of the circumference is substantially semicylindrical, the knife-edged projection projecting from said semicylindrical half of the holding stud.

22. The mounting device according to claim 1, wherein the stud holding means is resiliently biased to the first end position.

* * * * *